US012152486B2

(12) United States Patent
Murdoch et al.

(10) Patent No.: US 12,152,486 B2
(45) Date of Patent: Nov. 26, 2024

(54) METHOD AND SYSTEM FOR REMOTELY SIGNALLING A DOWNHOLE ASSEMBLY COMPRISING ONE OR MORE DOWNHOLE TOOL

(71) Applicant: Weatherford U.K. Limited, Leicestershire (GB)

(72) Inventors: Euan Murdoch, Leicestershire (GB); Matthew Knight, Leicestershire (GB); Richard Dalzell, Leicestershire (GB)

(73) Assignee: Weatherford U.K. Limited, Leicestershire (GB)

( * ) Notice: Subject to any disclaimer, the term of this patent is extended or adjusted under 35 U.S.C. 154(b) by 0 days.

(21) Appl. No.: 18/042,218

(22) PCT Filed: Sep. 14, 2021

(86) PCT No.: PCT/GB2021/052377
§ 371 (c)(1),
(2) Date: Feb. 19, 2023

(87) PCT Pub. No.: WO2022/058722
PCT Pub. Date: Mar. 24, 2022

(65) Prior Publication Data

US 2023/0323767 A1 Oct. 12, 2023

(30) Foreign Application Priority Data

Sep. 15, 2020 (GB) ..... 2014518

(51) Int. Cl.
*E21B 47/11* (2012.01)
*E21B 47/06* (2012.01)
(Continued)

(52) U.S. Cl.
CPC ..... *E21B 47/11* (2020.05); *E21B 47/06* (2013.01); *E21B 47/18* (2013.01); *E21B 34/10* (2013.01)

(58) Field of Classification Search
CPC ..... E21B 47/11; E21B 47/06; E21B 47/18; E21B 34/10; E21B 34/025; E21B 43/12; E21B 43/14
See application file for complete search history.

(56) References Cited

U.S. PATENT DOCUMENTS 4,856,595 A 8/1989 Upchurch
5,355,960 A 10/1994 Schultz
(Continued)

FOREIGN PATENT DOCUMENTS

EP 2917466 B1 6/2017
GB 2280013 A 1/1995
(Continued)

OTHER PUBLICATIONS

GB2014518.1, Combined Search and Examination Report, May 26, 2021, 12 pages.
(Continued)

*Primary Examiner* — Christopher J Sebesta
*Assistant Examiner* — Jennifer A Railey
(74) *Attorney, Agent, or Firm* — Peter V. Schroeder; Booth Albanesi Schroeder PLLC

(57) ABSTRACT

A method for remotely signalling a downhole assembly comprising one or more downhole tools includes operating a choke arrangement configured to control production fluid flow from a wellbore to produce a first pressure signature in the fluid flow, the first pressure signature defining a trigger signal for the one or more downhole tools of the downhole assembly. The first pressure signature comprises at least a first pressure signal and a second pressure signal in the
(Continued)

production fluid flow in the downhole assembly. Operating the choke arrangement to produce a second pressure signature in the production fluid flow in the downhole assembly at a predetermined time period following the first pressure signature, the second pressure signature defining a command signal for initiating operation of a predetermined one or more of the downhole tools of the downhole assembly.

15 Claims, 3 Drawing Sheets

(51) Int. Cl.
*E21B 47/18* (2012.01)
*E21B 34/10* (2006.01)

(56) References Cited

U.S. PATENT DOCUMENTS

| | | | | |
|---|---|---|---|---|
| 5,887,657 | A | 3/1999 | Bussear et al. | |
| 6,182,764 | B1 | 2/2001 | Vaynshteyn | |
| 6,199,629 | B1 | 3/2001 | Shirk et al. | |
| 6,712,160 | B1 * | 3/2004 | Schultz | E21B 41/0085 175/48 |
| 10,920,526 | B2 * | 2/2021 | Abeidoh | E21B 23/06 |
| 2003/0016164 | A1 * | 1/2003 | Finke | E21B 47/22 340/854.3 |
| 2005/0090985 | A1 | 4/2005 | Goodman | |
| 2006/0164256 | A1 | 7/2006 | Hudson | |
| 2007/0056745 | A1 * | 3/2007 | Contant | E21B 23/04 166/382 |
| 2010/0018714 | A1 * | 1/2010 | Merlau | E21B 34/10 166/374 |
| 2015/0285063 | A1 | 10/2015 | Purkis | |
| 2018/0106144 | A1 * | 4/2018 | Hyde, Jr. | E21B 43/267 |
| 2018/0347315 | A1 | 12/2018 | Murdoch | |

FOREIGN PATENT DOCUMENTS

| | | | |
|---|---|---|---|
| WO | 9931351 | | 6/1999 |
| WO | 2004081335 | A2 | 9/2004 |
| WO | 2005113936 | A1 | 12/2005 |
| WO | 2015135548 | A1 | 9/2015 |
| WO | 2018145215 | A1 | 8/2018 |
| WO | 2018226216 | A1 | 12/2018 |

OTHER PUBLICATIONS

PCT/GB2021/052377, International Search Report and Written Opinion, dated Nov. 2, 2021, 13 pages.

Green et al, "The Advance and Adoption of Wireless Intelligent Completions," Tendeka, World Oil, May 2019, 5 pages.

Tedeka, Catch the Next Wave in Completions, PulseEight Brochure, 2019, 7 pages.

* cited by examiner

METHOD AND SYSTEM FOR REMOTELY SIGNALLING A DOWNHOLE ASSEMBLY COMPRISING ONE OR MORE DOWNHOLE TOOL

FIELD

This relates to a method and system for remotely signalling a downhole assembly comprising one or more downhole tool. More particularly, this relates to a method and system for remotely signalling a downhole valve arrangement.

BACKGROUND

In the oil and gas exploration and production industry, in order to access a hydrocarbon bearing formation containing an oil and/or gas reservoir, a well borehole ("wellbore") is drilled from surface, the wellbore typically then being lined with sections of metal bore-lining tubing, commonly known as casing, which is cemented in place. The wellbore is then completed by installation of a wellbore completion system, including production equipment which facilitates the controlled ingress and transportation of production fluid, e.g. oil and/or gas, from the reservoir towards surface.

Wellbore completion systems are operable to facilitate a variety of operations in or on the well and are becoming ever more sophisticated. One challenge for operators is how to manage the ingress of water from the well, commonly known as water production, and completion systems have been employed which are capable of isolating water producing zones with a view to increasing production efficiency. However, while such completion systems are effective, they can be technically challenging and involve significant time and cost to install. Moreover, identification of water producing zones is difficult, typically requiring production logging and mechanical workover operations to be carried out, at significant cost, time and risk. Workover operations also require specialist equipment and in the offshore environment require specialist vessels which have limited availability.

One particular challenge is the ability to communicate with the downhole assembly, such as downhole valves and the like used to control fluid ingress into the completion system. In some instances, communication with downhole assembly is achieved by transmitting a pressure cycle from surface using the pumps at surface. In other instances, communication with downhole assembly is achieved by circulation of radio frequency identification (RFID) tags. However, neither technique is suited to signalling downhole assembly within a well that is actively producing.

SUMMARY

Aspects of the present disclosure relate to a method and system for remotely signalling a downhole assembly comprising one or more downhole tool.

According to a first aspect, there is provided a method for remotely signalling a downhole assembly comprising one or more downhole tools, the method comprising: operating a choke arrangement configured to control production fluid flow from a wellbore to produce a first pressure signature in the fluid flow, the first pressure signature defining a trigger signal for the one or more downhole tools of the downhole assembly, wherein the first pressure signature comprises at least a first pressure signal and a second pressure signal in the production fluid flow in the downhole assembly; and operating the choke arrangement to produce a second pressure signature in the production fluid flow in the downhole assembly at a predetermined time period following the first pressure signature, the second pressure signature defining a command signal for initiating operation of a predetermined one or more of the downhole tools of the downhole assembly.

Beneficially, the method permits a downhole assembly to be signaled using the production fluid flowing from the wellbore, and during production, i.e. while production fluid is flowing; while obviating the cost, time and risk associated with conventional systems and methodologies. Moreover, the method obviates the requirement for placement and/or running of control lines conventionally used to control operation of the downhole assembly.

The method may comprise the step of determining which of the one or more downhole tools is to receive the command signal. Determining which of the one or more downhole tools is to receive the command signal is carried out before operating the choke arrangement to produce the first pressure signature in the production fluid flow.

Determining which of the one or more downhole tools is to receive the command signal may comprise detecting and/or analysing a tracer element disposed in the fluid flowing in the downhole assembly. Detecting and/or analysing the tracer element may be carried out at surface. Alternatively or additionally, detecting and/or analysing the tracer element may be carried out downhole.

The tracer element may be disposed on, form part of and/or may be operatively associated with the one or more downhole tool.

The tracer element may initially be disposed on, form part of and/or may be operatively associated with the one or more downhole tool. The tracer element may then be transported to surface with the fluid flow.

The tracer element may be soluble in contact with a selected fluid, for example water or hydrocarbons. In use, the tracer element may dissolve in contact with water or hydrocarbons entering the wellbore, and thus provide an indication of where water or hydrocarbon ingress is present.

The tracer element may be dispersable in contact with the selected fluid, e.g. water or hydrocarbons. In use, the tracer element may disperse or disintegrate in contact with water or hydrocarbons entering the downhole assembly, and thus provide an indication of where water or hydrocarbon ingress is present.

A plurality of the tracer elements are provided, with one or more tracer element disposed on, coupled to, forming part of and/or operatively associated with the one or more downhole tools. The or each downhole tool may be provided with a tracer element. Alternatively, where a plurality of downhole tools are provided a selected number or subset of the downhole tools may be provided with a tracer element.

In use, the tracer element may be used to identify one or more downhole tool associated with a given formation zone. By detecting and/or analysing the tracer element, a condition at a particular downhole tool may be determined, e.g. that a particular formation zone is subject to water ingress.

The tracer element may comprise or take the form of a dye.

Alternatively or additionally, the tracer element may comprise or take the form of a chemical tracer, or other suitable tracer element.

As described above, the first pressure signature comprises a first pressure signal.

The first pressure signal may comprise or take the form of a predetermined increase in fluid pressure of the fluid flowing in the downhole assembly. The predetermined increase in fluid pressure of the fluid flowing in the downhole assembly may be maintained for a predetermined time period.

The first pressure signal may comprise or take the form of a predetermined decrease in fluid pressure of the fluid flowing in the downhole assembly. In particular but not exclusively, the first pressure signal may take the form of a predetermined increase in fluid pressure of the fluid flowing in the downhole assembly maintained for a predetermined time period followed by a predetermined decrease in fluid pressure of the fluid flowing in the downhole assembly.

However, the first pressure signal may take other forms. For example, the first pressure signal may comprise or take the form of a predetermined decrease in fluid pressure of the fluid flowing in the downhole assembly followed by a predetermined increase in fluid pressure of the fluid flowing in the downhole assembly. The predetermined decrease in fluid pressure of the fluid flowing in the downhole assembly may be maintained for a predetermined time period. Alternatively or additionally, the first pressure signal may comprise or take the form of a static pressure, that is the pressure may be maintained at a constant or substantially constant pressure for a predetermined time period.

As described above, the first pressure signature comprises a second pressure signal.

The second pressure signal may comprise or take the form of a predetermined increase in fluid pressure of the fluid flowing in the downhole assembly. The predetermined increase in fluid pressure of the fluid flowing in the downhole assembly may be maintained for a predetermined time period.

The second pressure signal may comprise or take the form of a predetermined decrease in fluid pressure of the fluid flowing in the downhole assembly. In particular but not exclusively, the second pressure signal may take the form of a predetermined increase in fluid pressure of the fluid flowing in the downhole assembly maintained for a predetermined time period followed by a predetermined decrease in fluid pressure of the fluid flowing in the downhole assembly.

However, the second pressure signal may take other forms. For example, the second pressure signal may comprise or take the form of a predetermined decrease in fluid pressure of the fluid flowing in the downhole assembly followed by a predetermined increase in fluid pressure of the fluid flowing in the downhole assembly. The predetermined decrease in fluid pressure of the fluid flowing in the downhole assembly may be maintained for a predetermined time period. Alternatively or additionally, the second pressure signal may comprise or take the form of a static pressure, that is the pressure may be maintained at a constant or substantially constant pressure for a predetermined time period.

The second pressure signal may be identical to the first pressure signal. Alternatively, the second pressure signal may be different to the first pressure signal.

The first pressure signature may comprise a third pressure signal.

The third pressure signal may comprise or take the form of a predetermined increase in fluid pressure of the fluid flowing in the downhole assembly. The predetermined increase in fluid pressure of the fluid flowing in the downhole assembly may be maintained for a predetermined time period.

The third pressure signal may comprise or take the form of a predetermined decrease in fluid pressure of the fluid flowing in the downhole assembly. In particular but not exclusively, the third pressure signal may comprise a predetermined increase in fluid pressure of the fluid flowing in the downhole assembly maintained for a predetermined time period followed by a predetermined decrease in fluid pressure of the fluid flowing in the downhole assembly.

However, the third pressure signal may take other forms. For example, the third pressure signal may comprise a predetermined decrease in fluid pressure of the fluid flowing in the downhole assembly followed by a predetermined increase in fluid pressure of the fluid flowing in the downhole assembly. The predetermined decrease in fluid pressure of the fluid flowing in the downhole assembly may be maintained for a predetermined time period. Alternatively or additionally, the third pressure signal may comprise or take the form of a static pressure, that is the pressure may be maintained at a constant or substantially constant pressure for a predetermined time period.

The third pressure signal may be identical to at least one of the first and second pressure signals. Alternatively, the third pressure signal may be different to at least one of the first and second pressure signals.

The first pressure signature may comprise n pressure signals, where $n \geq 2$.

The $n^{th}$ pressure signal may comprise a predetermined increase in fluid pressure of the fluid flowing in the downhole assembly. The predetermined increase in fluid pressure of the fluid flowing in the downhole assembly may be maintained for a predetermined time period.

The $n^{th}$ pressure signal may comprise a predetermined decrease in fluid pressure of the fluid flowing in the downhole assembly. In particular but not exclusively, the $n^{th}$ pressure signal may comprise a predetermined increase in fluid pressure of the fluid flowing in the downhole assembly maintained for a predetermined time period followed by a predetermined decrease in fluid pressure of the fluid flowing in the downhole assembly.

However, the $n^{th}$ pressure signal may take other forms. For example, the $n^{th}$ pressure signal may comprise a predetermined decrease in fluid pressure of the fluid flowing in the downhole assembly followed by a predetermined increase in fluid pressure of the fluid flowing in the downhole assembly. The predetermined decrease in fluid pressure of the fluid flowing in the downhole assembly may be maintained for a predetermined time period. Alternatively or additionally, the $n^{th}$ pressure signal may comprise or take the form of a static pressure, that is the pressure may be maintained at a constant or substantially constant pressure for a predetermined time period.

The $n^{th}$ pressure signal may be identical to at least one of the first, second and third pressure signals. Alternatively, the $n^{th}$ pressure signal may be different to at least one of the first, second and third pressure signals.

As described above, the method comprises operating the choke arrangement to produce one or more command signal for initiating operation of one or more the downhole tool of the downhole assembly.

Beneficially, this permits an operator to selectively communicate a command signal to a particular downhole tool or selection of the downhole tools using the production fluid flowing through the downhole assembly.

The or each downhole tool may be operatively associated with a particular predetermined time period following the first pressure signature. For example but not exclusively, the one or more downhole tools associated with a given formation zone may be associated with a particular predetermined time period following the first pressure signature.

The second pressure signature may comprise a first pressure signal.

The first pressure signal of the second pressure signature may be produced at a first predetermined time following the first pressure signature. The first pressure signal of the second pressure signature may be associated with a first downhole tool or selection of the downhole tools.

The first pressure signal of the second pressure signature may comprise or take the form of a predetermined increase in fluid pressure of the fluid flowing in the downhole assembly. The predetermined increase in fluid pressure of the fluid flowing in the downhole assembly may be maintained for a predetermined time period.

The first pressure signal of the second pressure signature may comprise a predetermined decrease in fluid pressure of the fluid flowing in the downhole assembly.

In particular but not exclusively, the first pressure signal of the second pressure signature may comprise a predetermined increase in fluid pressure of the fluid flowing in the downhole assembly maintained for a predetermined time period followed by a predetermined decrease in fluid pressure of the fluid flowing in the downhole assembly.

However, the first pressure signal of the second pressure signature may take other forms. For example, the first pressure signal of the second pressure signature may comprise a predetermined decrease in fluid pressure of the fluid flowing in the downhole assembly followed by a predetermined increase in fluid pressure of the fluid flowing in the downhole assembly. The predetermined decrease in fluid pressure of the fluid flowing in the downhole assembly may be maintained for a predetermined time period. Alternatively or additionally, the first pressure signal of the second pressure signature may comprise or take the form of a static pressure, that is the pressure may be maintained at a constant or substantially constant pressure for a predetermined time period.

The second pressure signature may comprise a second pressure signal.

The second pressure signal of the second pressure signature may be produced at a second predetermined time following the first pressure signature. The second pressure signal of the second pressure signature may be associated with a second downhole tool or selection of the downhole tools.

The second pressure signal of the second pressure signature may comprise or take the form of a predetermined increase in fluid pressure of the fluid flowing in the downhole assembly. The predetermined increase in fluid pressure of the fluid flowing in the downhole assembly may be maintained for a predetermined time period.

The second pressure signal of the second pressure signature may comprise or take the form of a predetermined decrease in fluid pressure of the fluid flowing in the downhole assembly. In particular but not exclusively, the second pressure signal of the second pressure signature may comprise or take the form of a predetermined increase in fluid pressure of the fluid flowing in the downhole assembly maintained for a predetermined time period followed by a predetermined decrease in fluid pressure of the fluid flowing in the downhole assembly.

However, the second pressure signal of the second pressure signature may take other forms. For example, the second pressure signal of the second pressure signature may comprise or take the form of a predetermined decrease in fluid pressure of the fluid flowing in the downhole assembly followed by a predetermined increase in fluid pressure of the fluid flowing in the downhole assembly. The predetermined decrease in fluid pressure of the fluid flowing in the downhole assembly may be maintained for a predetermined time period. Alternatively or additionally, the second pressure signal of the second pressure signature may comprise or take the form of a static pressure, that is the pressure may be maintained at a constant or substantially constant pressure for a predetermined time period.

The second pressure signal may be identical to the first pressure signal. Alternatively, the second pressure signal may be different to the first pressure signal.

The second pressure signature may comprise n number of pressure signals, where $n \geq 1$.

The $n^{th}$ pressure signal may comprise a predetermined increase in fluid pressure of the fluid flowing in the downhole assembly. The predetermined increase in fluid pressure of the fluid flowing in the downhole assembly may be maintained for a predetermined time period.

The $n^{th}$ pressure signal may comprise a predetermined decrease in fluid pressure of the fluid flowing in the downhole assembly. In particular but not exclusively, the $n^{th}$ pressure signal may comprise a predetermined increase in fluid pressure of the fluid flowing in the downhole assembly maintained for a predetermined time period followed by a predetermined decrease in fluid pressure of the fluid flowing in the downhole assembly.

However, the $n^{th}$ pressure signal may take other forms. For example, the $n^{th}$ pressure signal may comprise a predetermined decrease in fluid pressure of the fluid flowing in the downhole assembly followed by a predetermined increase in fluid pressure of the fluid flowing in the downhole assembly. The predetermined decrease in fluid pressure of the fluid flowing in the downhole assembly may be maintained for a predetermined time period. Alternatively or additionally, the $n^{th}$ pressure signal of the second pressure signature may comprise or take the form of a static pressure, that is the pressure may be maintained at a constant or substantially constant pressure for a predetermined time period.

The $n^{th}$ pressure signal may be identical to at least one of the first and second pressure signals. Alternatively, the $n^{th}$ pressure signal may be different to at least one of the first, second and third pressure signals.

As described above, the first pressure signature and the second pressure signature are created by operating the choke arrangement.

The method may comprise operating the choke arrangement to increase the pressure of the fluid flowing in the downhole assembly. In particular, operating the choke arrangement to increase the pressure of the fluid flowing in the downhole assembly may comprise reducing the size of a flow passage, e.g. orifice, through the choke arrangement. The flow passage may be reduced by moving a valve member of the choke arrangement towards a valve seat of the choke arrangement, so as to reduce the flow area therebetween. Alternatively or additionally, the flow passage may be reduced by moving the valve seat towards the valve member of the choke arrangement, so as to reduce the flow area therebetween.

The method may comprise operating the choke arrangement to decrease the pressure of the fluid flowing in the downhole assembly. In particular, operating the choke arrangement to decrease the pressure of the fluid flowing in the downhole assembly may comprise increasing the size of the flow passage, e.g. orifice, through the choke arrangement. The flow passage may be increased by moving the valve member of the choke arrangement away from the valve seat of the choke arrangement, so as to increase the flow area therebetween. Alternatively or additionally, the flow passage may be increased by moving the valve seat away from the valve member of the choke arrangement, so as to increase the flow area therebetween.

The method may comprise operating the choke arrangement to provide a static pressure of the production fluid flow.

The method may comprise the step of detecting the first pressure signature.

The method may comprise the step of detecting the second pressure signature.

The method may comprise detecting the first pressure signature and the second pressure signature using a downhole sensor arrangement.

The downhole sensor arrangement may form part of, may be coupled to or operatively associated with the downhole assembly. For example, the sensor arrangement may comprise one pressure sensor or a plurality of pressure sensors configured to detect the first pressure signature and the second pressure signature.

Each of the downhole tools, or each group of downhole tools, e.g. the one or more downhole tools operatively associated with a particular formation zone, may be provided with one or more pressure sensor of the downhole sensor arrangement.

The method may comprise operating the selected downhole tool or group of downhole tools in response to the detected command signal.

According to a second aspect, there is provided a downhole assembly comprising:

one or more downhole tool for location in a wellbore;

a sensor arrangement forming part of, coupled to or operatively associated with the one or more downhole tool, wherein the sensor arrangement is configured to detect a first pressure signature produced in the fluid flow in the downhole assembly by a choke arrangement, the first pressure signature defining a trigger signal for the downhole assembly, wherein the first pressure signature comprises at least a first pressure signal and a second pressure signal in the fluid flow in the downhole assembly, and wherein the sensor arrangement is configured to detect a second pressure signature produced in the fluid flow in the downhole assembly by the choke arrangement, the second pressure signature defining a command signal for initiating operation of a predetermined one or more downhole tool of the downhole assembly; and an actuation arrangement forming part of, coupled to or operatively associated with the one or more downhole tool, the actuation arrangement configured to initiate operation of the selected one or more downhole tool of the downhole assembly in response to the second pressure signature.

The assembly may comprise a tracer element disposed on, coupled to, forming part of and/or operatively associated with the one or more downhole tools, the tracer element configured to be transported towards surface with the fluid flow from the wellbore, the tracer element indicating which of the one or more downhole tools is to receive the command signal.

The tracer element may be disposed on, form part of and/or may be operatively associated with the one or more downhole tool.

The tracer element may initially be disposed on, form part of and/or may be operatively associated with the one or more downhole tool. The tracer element may then be transported to surface with the fluid flow.

The tracer element may be soluble in contact with a selected fluid, for example water or hydrocarbons. In use, the tracer element may dissolve in contact with water or hydrocarbons entering the wellbore, and thus provide an indication of where water or hydrocarbon ingress is present.

The tracer element may be dispersable in contact with the selected fluid, e.g. water or hydrocarbons. In use, the tracer element may disperse or disintegrate in contact with water or hydrocarbons entering the wellbore, and thus provide an indication of where water or hydrocarbon ingress is present.

A plurality of the tracer elements are provided, with one or more tracer element disposed on, coupled to, forming part of and/or operatively associated with the one or more downhole tools. The or each downhole tool may be provided with a tracer element. Alternatively, where a plurality of downhole tools are provided a selected number or subset of the downhole tools may be provided with a tracer element.

In use, the tracer element may be used to identify one or more downhole tool associated with a given wellbore zone. By detecting and/or analysing the tracer element, a condition at a particular downhole tool may be determined, e.g. that a particular wellbore zone is subject to water ingress.

The tracer element may comprise or take the form of a dye.

Alternatively or additionally, the tracer element may comprise or take the form of a chemical tracer, or other suitable tracer element.

The assembly may comprise or take the form of a completion system.

The one or more downhole tool may comprise a downhole flow control device. The downhole flow control device may comprise or take the form of a valve. The downhole flow control device may comprise a lateral flow passage for communicating production fluid into the downhole assembly. The downhole flow control device may be configurable between a first, open, configuration in which production fluid ingress into the downhole assembly is permitted and a second, closed, configuration in which production fluid ingress is prevented or at least restricted. The downhole flow control device may comprise a body and valve member, such as flapper or sliding sleeve, the valve member being movable relative to the body to reconfigure the flow control device between the first configuration and the second configuration.

According to a third aspect, there is provided a system comprising:

the downhole assembly according to the second aspect;

a choke arrangement configured to control fluid flow from a wellbore, wherein the choke arrangement is configurable to produce the first pressure signature in the fluid flow, the first pressure signal defining the trigger signal for one or more downhole tool of the downhole assembly, and wherein the choke arrangement is configurable to produce the second pressure signal in the fluid flow at a predetermined time period following the first pressure signature, the second pressure signature defining the command signal for the selected one or more of the downhole tools.

The choke arrangement may comprise or form part of a surface choke arrangement, for example provided in or forming part of a wellhead of an oil and/or wellbore. More specifically, but not exclusively, the choke arrangement may form part of, may be coupled to or operatively associated with a valve arrangement, such as a Christmas tree.

Alternatively or additionally, part of the choke arrangement may be disposed downhole.

The choke arrangement may comprise or take the form of an adjustable choke.

The choke arrangement may comprise or take the form of a valve having an adjustable orifice.

The invention is defined by the appended claims. However, for the purposes of the present disclosure it will be understood that any of the features defined above or described below may be utilised in isolation or in combination. For example, features described above in relation to one of the above aspects or below in relation to the detailed description may be utilised in any other aspect, or together form a new aspect.

BRIEF DESCRIPTION OF THE DRAWINGS

These and other aspects will now be described, by way of example, with reference to the accompanying drawings, of which.

DETAILED DESCRIPTION OF THE DRAWINGS

Figure 1:
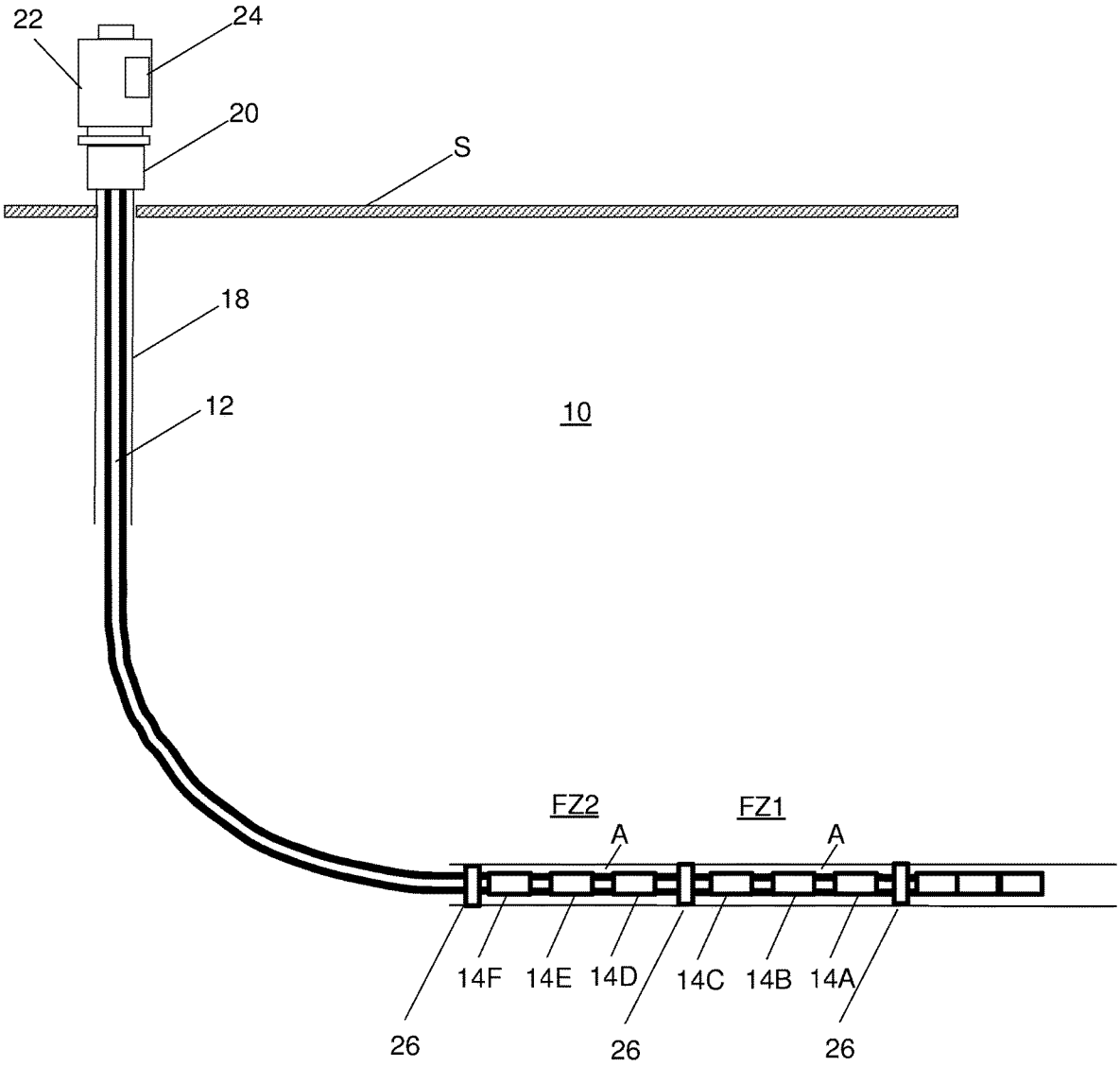
FIG. 1 shows a diagrammatic view of a system for remotely signalling a downhole assembly comprising one or more downhole tool.

Referring first to FIG. 1 of the accompanying drawings, there is shown a system 10 for remotely signalling a downhole assembly 12 comprising a number of downhole tools 14A,14B,14C,14D,14E,14F.

As shown in FIG. 1, the illustrated system 10 includes a subsea wellbore 16 extending from a wellhead 18 disposed at the seabed S. A valve arrangement 20, which in the illustrated system 10 takes the form of a Christmas tree, is disposed on the wellhead 18 and communicates with surface via a marine riser 22.

While the illustrated system 10 takes the form of a subsea system 10, it will be understood that the system 10 may take any suitable form, whether subsea or onshore.

As also shown in FIG. 1, the valve arrangement 20 comprises a choke arrangement 24 configured to control production fluid flow from the wellbore 18. In the illustrated system 10, the choke arrangement 24 comprises an adjustable choke having a valve member movable relative to a valve seat so as to vary the area of a flow passage defined therebetween. The area of the flow passage is reduced by moving the valve member of the choke arrangement 24 towards the valve seat, the resultant reduction in the area of the flow passage causing an increase in pressure in the production fluid. The area of the flow passage is increased by moving the valve member of the choke arrangement 24 away from the valve seat, the resultant increase in the area of the flow passage causing a decrease in pressure in the production fluid.

As will be described further below, the choke arrangement 24 is operable to relay a trigger signal to the downhole assembly 12 and a command signal for initiating operation of a selected one or more downhole tool of the downhole assembly 12.

In the illustrated system 10 shown in FIG. 1, the downhole assembly 12 takes the form of a completion string, with a number of the downhole tools 14A,14B,14C disposed adjacent to, and operatively associated with, a first formation zone FZ1 and a number of the downhole tools 14D,14E,14F disposed adjacent to, and operatively associated with, a second formation zone FZ2.

The downhole assembly 12 further comprises barrier members 26, which in the illustrated system 10 comprise packers, for isolating portions of the annulus A between the assembly 12 and the wellbore 16 to facilitate zonal isolation of the formation zones FZ1,FZ2, and facilitate ingress of production fluid into the assembly 12 via the downhole tools 14A,14B,14C,14D,14E,14F.

Figure 2:
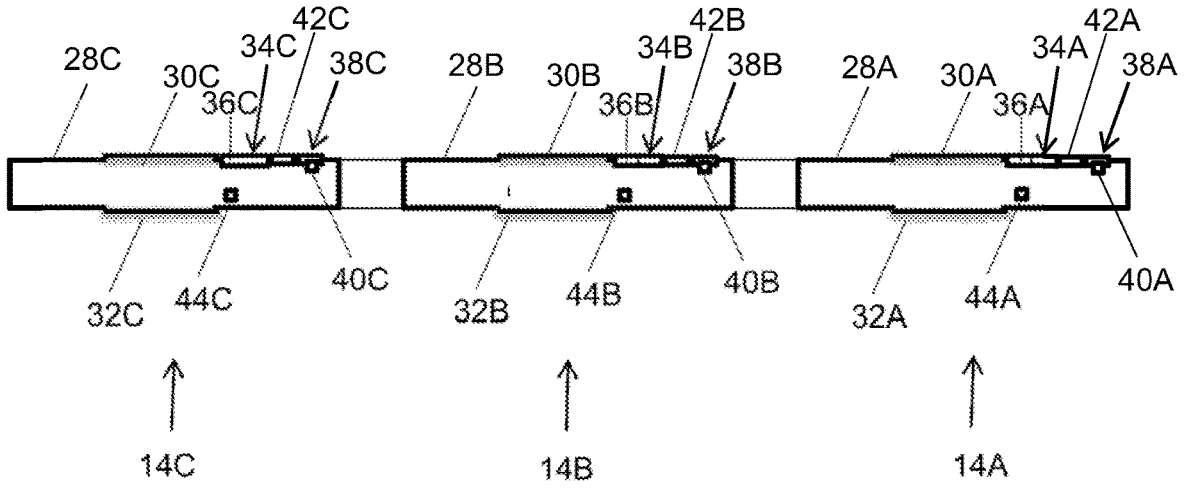
FIG. 2 shows an enlarged view of first, downhole, part of the downhole assembly of the system shown in FIG. 1.
Figure 3:
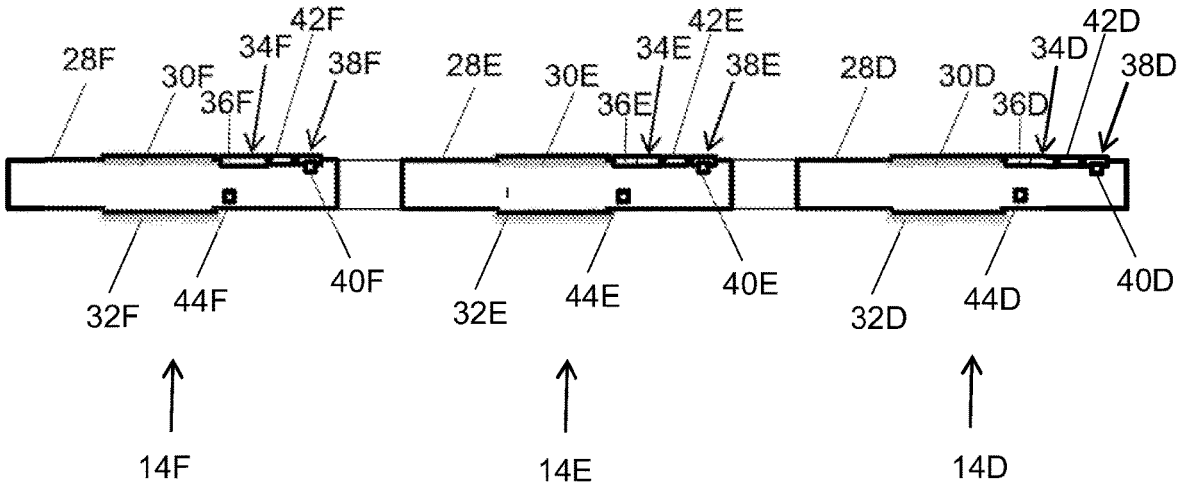
FIG. 3 shows an enlarged view of second, uphole, part of the downhole assembly of the system shown in FIG. 1.

Referring now also to FIGS. 2 and 3 of the accompanying drawings, which shows an enlarged view of part of the downhole assembly 12 shown in FIG. 1, it can be seen that the downhole tools 14A,14B,14C,14D,14E,14F take the form of flow control devices, each having a body 28A,28B,28C,28D,28E,28F having a lateral flow passage 30A,30B,30C,30D,30E,30F disposed therethrough for communicating production fluid into the downhole assembly 12 and a valve member 32A,32B,32C,32D,32E,32F configured to provide selective communication of the production fluid through the respective lateral flow passage 30A,30B,30C,30D,30E,30F.

In the illustrated downhole tools 14A,14B,14C,14D,14E,14F, the valve members 32A,32B,32C,32D,32E,32F take the form of sliding sleeves. However, it will be understood that the valve members may take any suitable form, such as a flapper.

The downhole tools 14A,14B,14C,14D,14E,14F are each configurable between a first, open, configuration in which production fluid ingress into the downhole assembly 12 is permitted and a second, closed, configuration in which production fluid ingress is prevented or at least restricted.

As shown in FIGS. 2 and 3, each of the downhole tools 14A,14B,14C,14D,14E,14F has an actuation arrangement, generally denoted 34A,34B,34C,34D,34E,34F. In the illustrated system 10, the actuation arrangements 34A,34B,34C,34D,34E,34F each take the form of a fluid powered actuation arrangement comprising an actuation piston 36A,36B,36C,36D,36D,36E,36F, each of the pistons 36A,36B,36C,36D,36D,36E,36F coupled to a respective valve member 32A,32B,32C,32D,32E,32F and operable to reconfigure their respective downhole tool 14A,14B,14C,14D,14E,14F from the first, open, configuration to the second, closed, configuration, and vice-versa.

As also shown in FIGS. 2 and 3, each of the downhole tools 14A,14B,14C,14D,14E,14F has a sensor arrangement, generally denoted 38A,38B,38C,38D,38E,38F. The sensor arrangements 38A,38B,38C,38D,38E,38F each comprise one or more pressure gauge 40A,40B,40C,40D,40E,40F operable to detect the pressure of the production fluid.

As shown in FIGS. 2 and 3, each of the downhole tools 14A,14B,14C,14D,14E,14F has a controller, generally denoted 42A,42B,42C,42D,42E,42F. The controllers 42A,42B,42C,42D,42E,42F are configured to receive one or more input signal from the sensor arrangements 38A,38B,38C,38D,38E,38F indicative of the pressure in the production fluid and output one or more command signal to the actuation arrangements 34A,34B,34C,34D,34E,34F to initiate operation of the valve members 32A,32B,34C,34D,34E,34F.

As described above, the choke arrangement 24 is operable to relay a trigger signal to the downhole assembly 12 in the form of a first pressure signature imparted into the production fluid flow and a command signal for initiating operation of a selected one or more downhole tool of the downhole assembly 12 in the form of a second pressure signature imparted into the production fluid flow.

Figure 4:
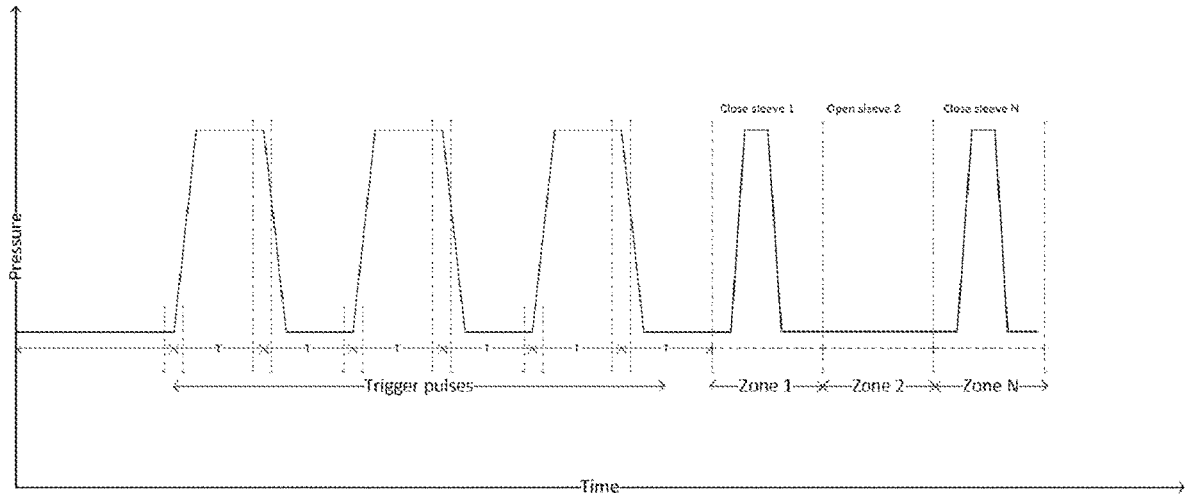
FIG. 4 shows a graph showing an example of the first pressure signature and the second pressure signature used to remotely signal one or more selected downhole tool of the downhole assembly shown in FIGS. 1 and 2.

Referring now also to FIG. 4 of the accompanying drawings, there is shown an example of the trigger signal and command signal used to operate downhole tools 14A,14B, 14C of the downhole assembly 12.

As shown in FIG. 4, the trigger signal takes the form of a first pressure signature comprising three pressure pulses produced by adjusting the choke arrangement 24 as described above. In the illustrated system 10, the first pressure signature comprises a first pressure signal, a second pressure signal and a third pressure signal. The first pressure signal takes the form of a predetermined increase in fluid pressure of the production fluid flow maintained for a predetermined time period followed by a predetermined decrease in the fluid pressure of the production fluid flow. The second first pressure signal is identical to the first pressure signal, taking the form of a predetermined increase in fluid pressure of the production fluid flow maintained for a predetermined time period followed by a predetermined decrease in fluid pressure of the production fluid flow. The third pressure signal is identical to the first and second pressure signals, taking the form of a predetermined increase in fluid pressure of the production fluid flow maintained for a predetermined time period followed by a predetermined decrease in fluid pressure of the production fluid flow.

The sensor arrangements 38A,38B,38C,38D,38E,38F of all of the downhole tools 14A,14B,14C,14D,14E,14F of the downhole assembly 12 monitor—continuously or with sufficient sample rate to detect the trigger signal—the pressure of the production fluid flow, the controllers 42A,42B,42C, 42D,42E,42F determining from the sensor data received from the sensor arrangements 38A,38B,38C,38D,38E,38F that the trigger signal has been produced.

The sensor arrangements 38A,38B,38C,38D,38E,38F of all of the downhole tools 14A,14B,14C,14D,14E,14F of the downhole assembly 12 continue to monitor—continuously or with sufficient sample rate—the pressure of the production fluid flow, controllers 42A,42B,42C,42D,42E,42F determining from the sensor data received from the sensor arrangements 38A,38B,38C,38D,38E,38F whether the command signal has been produced.

The command signal takes the form of a second pressure signature in the production fluid flow at a predetermined time period following the first pressure signature. As shown in FIG. 4, the second pressure signature comprises two pressure pulses at a time interval with corresponds to the downhole tools 14A,14C.

On detecting the second pressure signature, which will vary depending on which of the downhole tools 14A has been selected to operate, the controllers 42A,42B,42C,42D, 42E,42F will act accordingly. In the illustrated system 10, the controllers 42A, 42C will send a command signal to their respective actuation arrangements 34A,34C to initiate operation of the downhole tools 14A,14C while the remaining controllers 34B,34D,34E,34F will either take no action or send a signal to their actuation arrangements 34B, 34D34E34F to remain in their present state. The controllers 34B,34D,34E,34F may then return to a dormant state until a trigger signal is again detected.

In order to determine which of the downhole tools is to be operated, and as shown in FIG. 2, each of the downhole tools 14A,14B,14C,14D,14E,14F has a tracer element 44A,44B, 44C,44D,44E,44F disposed thereon.

The tracer elements 44A,44B,44C,44D,44E,44F may take a number of different forms and in the illustrated system 10 the tracer elements 44A,44B,44C,44D,44E,44F take the form of a dye soluble in contact with water in the production fluid, and thus provide an indication of where water ingress is present.

By detecting and/or analysing the tracer elements 44A, 44B,44C,44D,44E,44F at surface, the condition at a particular downhole tool 14A,14B,14C,14D,14E,14F may be determined, e.g. that a particular wellbore zone is subject to water ingress.

It will be recognised that the method, assembly and system described above are merely exemplary and that various modifications may be made without departing from the scope of the claimed invention as defined by the appended claims.

For example, while in the illustrated system 10, each of the downhole tools 14A,14B,14C,14D,14E,14F has a sensor arrangement 38A,38B,38C,38D,38E,38F, the downhole tools 14A,14B,14C operatively associated with the formation zone FZ1 may alternatively comprise a common sensor arrangement and the downhole tools 14D,14E,14F operatively associated with formation zone FZ2 may comprise a common sensor arrangement, such that all of the downhole tools operatively associated with a given formation zone may be operated together.

While in the illustrated system 10, each of the downhole tools 14A,14B,14C,14D,14E,14F has an actuation arrangement 34A,34B,34C,34D,34E,34F, the downhole tools 14A, 14B,14C operatively associated with the formation zone FZ1 may alternatively comprise a common actuation arrangement and the downhole tools 14D,14E,14F operatively associated with formation zone FZ2 may comprise a common actuation arrangement, such that all of the downhole tools operatively associated with a given formation zone may be operated together.

While in the illustrated system 10, each of the downhole tools 14A,14B,14C,14D,14E,14F has a tracer element 44A, 44B,44C,44D,44E,44F, the downhole tools 14A,14B,14C operatively associated with the formation zone FZ1 may alternatively comprise a common tracer element and the downhole tools 14D,14E,14F operatively associated with formation zone FZ2 may comprise a common tracer element.

The invention claimed is:

1. A method for remotely signaling a downhole assembly comprising one or more downhole tools, the method comprising:

detecting a tracer element operatively associated with one or more of the downhole tools, wherein the tracer element is disposed on at least one of the downhole tools and is transportable with a production fluid flow from the well bore;

determining from the presence of the tracer element in the production fluid flow which of the one or more downhole tools of the downhole assembly is to receive a command signal for initiating its operation; and then operating a choke arrangement configured to control the production fluid flow to produce a trigger signal for the determined one or more downhole tools of the downhole assembly, wherein the trigger signal takes the form of a first pressure signature comprising at least a first pressure signal and a second pressure signal in the production fluid flow in the downhole assembly; and operating the choke arrangement to produce the command signal for initiating operation of the determined one or more of the downhole tools of the downhole assembly, wherein the command signal takes the form of a second pressure signature in the production fluid flow in the downhole assembly at a predetermined time period following the first pressure signature.

2. The method of claim 1, wherein at least one of the first pressure signal and the second pressure signal comprises or takes the form of at least one of:

a predetermined increase in fluid pressure of the production fluid flow;

a predetermined decrease in fluid pressure of the production fluid flow; and a static fluid pressure of the production fluid flow.

3. The method of claim 1, wherein the first pressure signature comprises n pressure signals, where n≥2.

4. The method of claim 1, wherein each downhole tool is operatively associated with a particular predetermined time period following the first pressure signature.

5. The method of claim 1, wherein the second pressure signature comprises a first pressure signal at a first predetermined time following the first pressure signature, the first pressure signal comprising at least one of:

a predetermined increase in fluid pressure of the production fluid flow;

a predetermined decrease in fluid pressure of the production fluid flow; and a static fluid pressure of the production fluid flow.

6. The method of claim 5, wherein the second pressure signature comprises a second pressure signal at a second predetermined time following the first pressure signature, the second pressure signal comprising at least one of:

a predetermined increase in fluid pressure of the production fluid flow a predetermined decrease in fluid pressure of the production fluid flow; and a static fluid pressure of the production fluid flow.

7. The method of claim 1, wherein the second pressure signature comprises n number of pressure signals, where n≥1.

8. The method of claim 1, comprising operating the choke arrangement to at least one of:

increase the pressure of the production fluid flow;

decrease the pressure of the production fluid flow; and provide a static pressure of the production fluid flow.

9. The method of claim 1, comprising the step of detecting at least one of the first pressure signature and the second pressure signature using a downhole sensor arrangement forming part of, coupled to or operatively associated with the downhole assembly.

10. The method of claim 1, comprising operating the selected downhole tool or group of downhole tools in response to the detected command signal.

11. A system comprising:

a downhole assembly comprising:

one or more downhole tool for location in a wellbore;

a sensor arrangement forming part of, coupled to or operatively associated with the one or more downhole tools, wherein the sensor arrangement is configured to detect a trigger signal for a determined one or more downhole tools of the downhole assembly, wherein the trigger assembly comprises a first pressure signature comprising at least a first pressure signal and a second pressure signal in the fluid flow in the downhole assembly, and wherein the sensor arrangement is configured to detect a command signal for initiating operation of a predetermined one or more downhole tool, wherein the command signal takes the form of a second pressure signature in the production fluid flow in the downhole assembly; and an actuation arrangement forming part of, coupled to or operatively associated with the one or more downhole tools, wherein the actuation arrangement is configured to initiate operation of the selected one or more downhole tools of the downhole assembly in response to the command signal; and a tracer element disposed on and operatively associated with the one or more downhole tools, wherein the tracer element is configured to be transported towards surface with the production fluid flow; and a choke arrangement configured to control the production fluid flow from the well bore, wherein the choke arrangement is configurable to produce the first pressure signature in the production fluid flow, and wherein the choke arrangement is configurable to produce the second pressure signature in the production fluid flow at a predetermined time period following the first pressure signature, and wherein the system is configured to determine which of the one or more downhole tools of the downhole assembly is to receive the command signal by detecting the tracer element associated with one or more of the downhole tools.

12. The downhole assembly of claim 11, wherein the tracer element is soluble or dispersable in contact with a selected fluid.

13. The downhole assembly of claim 11, wherein the tracer element comprises or takes the form of a dye or a chemical tracer.

14. The downhole assembly of claim 11, wherein the downhole assembly comprises or take the form of a completion system.

15. The downhole assembly of claim 11, wherein the one or more downhole tool comprises a downhole flow control device.

* * * * *